United States Patent [19]

Dyson et al.

[11] Patent Number: 4,830,628

[45] Date of Patent: May 16, 1989

[54] SCREENED MULTICORE CABLE CONNECTORS

[75] Inventors: David J. Dyson, Reading; Anthony L. Chew, Thatcham, both of England

[73] Assignee: Kern Electric Components Limited, Berkshire, England

[21] Appl. No.: 126,015

[22] Filed: Nov. 27, 1987

[30] Foreign Application Priority Data

Nov. 29, 1986 [GB] United Kingdom ..... 8628606
Jul. 31, 1987 [GB] United Kingdom ..... 8718238

[51] Int. Cl.[4] ..... H01R 17/08

[52] U.S. Cl. ..... 439/584; 439/579; 439/610

[58] Field of Search ..... 439/607–610, 439/580, 583, 584, 579

[56] References Cited

U.S. PATENT DOCUMENTS

| | | | |
|---|---|---|---|
| 3,078,436 | 2/1963 | Berry | 439/579 |
| 3,320,575 | 5/1967 | Brown et al. | 439/584 |
| 3,739,076 | 6/1973 | Schwartz | 439/583 |
| 3,757,279 | 9/1973 | Winston | 439/584 |
| 4,213,664 | 7/1980 | McClenan | 439/584 |
| 4,243,290 | 1/1981 | Williams | 439/610 |

FOREIGN PATENT DOCUMENTS

| | | | |
|---|---|---|---|
| 167738 | 1/1986 | European Pat. Off. | 439/584 |

*Primary Examiner*—Eugene F. Desmond
*Attorney, Agent, or Firm*—Finnegan, Henderson, Farabow, Garrett & Dunner

[57] ABSTRACT

A backshell for a connector (11) for a multicore cable (1) of the type formed from a plurality of individually screened wires (2), the backshell being generally cylindrical and releasably attachable to a connector and, in use, having the cable (1) passing therethrough, the backshell comprising an electrically-conductive body portion (9), termination means (16) releasably attachable to the body portion, and an electrically-conductive inner cylindrical member (18) having a slot (19) extending from one end and generally parallel to the longitudinal axis of the inner member, the slot, in use, receiving one end of an electrically-conductive ribbon (22) wound around the wires (2) of the cable (1) in contact with the individual screens (5) thereof, the inner cylindrical member (18) being rotatable so as to wind the ribbon (22) around the periphery of the cable surrounded by the inner member, the application of the termination means (16) to the backshell body portion (9) serving electrically to connect the individual wire screens (5) to the backshell end hence to the connector (11).

4 Claims, 3 Drawing Sheets

SCREENED MULTICORE CABLE CONNECTORS

This invention relates to screened, multicore cable connectors and a method of connecting a multicore cable to such a connector, the connectors being used to connect multicore cables to apparatus to which signals are to be applied and/or from which signals are to be taken. For convenience, such connectors will be referred to throughout this application as "multicore connectors".

Screened multicore cables take two basic forms; the first comprises a plurality of individually insulated wires formed into a bundle (normally of generally circular cross-section) and contained within an overall metallic sheath or screen which in turn is contained within an overall insulating sheath or sleeve; the second comprises a plurality of individually insulated and screened wires formed into a bundle and contained within an overall insulating sleeve. The wires of the second type of cable normally comprise an inner conductor (solid or multistranded) covered by an insulating sleeve which in turn is covered by the screening "sleeve" and this may be covered by a further insulating sleeve. A variant of this type of cable is for an overall metal sheath or screen to be provided for the bundle of wires to augment the individual wire screening.

It will be known by those skilled in the art that the cables having only an overall screen are used where inter-wire signal radiation can be tolerated, and cables having individual screened wires are used when inter-wire signal radiation is no acceptable.

In order to connect multicore cables to apparatus, it is necessary to cause multipin connectors and in order to preserve the electrical screening at the connector, steps are taken electrically to connect the connector to the overall screening or individual wire screening, as appropriate. In both instances, it is conventional to provide the connector with a so-called "backshell" which is essentially a cylinder which slips over the cable behind the basic connector and is screwed to the latter. Within the backshell there may be provided a so-called "iris spring" which is a coil of wire of generally circular cross-section and which is formed into an annulus and slipped over the cable for engagement with an internal, tapered annular flange at the rear end of the basic connector. At this location, the overall insulating sheath or sleeve of the cable is stripped for a predetermined length to expose the overall screen. When the backshell is screwed onto the connector, a flanged collar freely disposed within the backshell forces the iris spring axially of the cable into contact with the tapered flange on the basic connector which in turn forces the iris spring radially inwardly to grip the exposed cable screen around its entire periphery. The collar is acted upon by an internal annular flange at the outer end of the backshell. Thus, a very positive electrical contact is made between the cable screen and the overall connector, via the iris spring, which contact is easily broken and reformed should this be necessary. The backshell may include an internal O-ring with the annular flange of the backshell being tapered in a similar fashion to that of the connector so as to force the O-ring radially inwardly when the backshell is connected to the connector so as to grip and seal against the overall cable insulating sheath or sleeve and axially against the flanged collar so as to make the overall connector fluid tight up to a predetermined pressure.

Essentially the same connector is used with cables having individually screened wires but the assembly thereof is much more time consuming because it is necessary to ensure that the screen of each wire is connected electrically to the connector. This is achieved by first stripping from the end of the cable a predetermined length of overall insulation, the same lenth of any overall screen, if provided, and a length of any overall insulation on each wire in order to reveal the individual wire screen. As is known, this screen, as with any overall screen, is typically a plaited braid of fine metallic strands and the braid on each individual wire has to be unwound and brought back along the wire and twisted into a single element. This is known as pigtailing and each pigtail is laid between a coil of the iris spring, with the pigtails being spaced around the spring and the free ends thereof tapered or otherwise secured to the exterior of the unstripped portion of the cable. Thus, when the backshell is connected to the connector as before, the iris spring is forced radially inwardly, again as before, whereby the coils of the spring close up and grip the pigtails to provide the desired electrical contact.

It will be seen that the connector assembly procedure for cables having individually screened wires is very labour intensive and the fact that the screening has to be removed from the outer ends of the individual wires gives rise to an electrical window which is undesirable. This problem is aggravated by the trend towards the use of smaller diameter wires and hence an increase in the number of wires for a given overall diameter of cable. The move towards smaller diameter wires comes with the technological advance in being able to accept much smaller signal levels. The resultant saving in size and weight is very important for many applications, such as aircraft, but the increase in the number of wires for a given size of cable presents a problem when individually screened wires are employed. This is because not only is the task of pigtailing made virtually impossible, but the number of pigtails to be laced through the iris spring cannot be accommodated.

The invention was first applied to this type of multicore cable connector, i.e. that provided with one or more iris springs, but has been found to be equally applicable to the simpler braid-trap type. In the braid-trap type, the connector is basically of two parts, namely a backshell having a body portion and termination means, such as a backnut, releasably attachable to the body portion. The body portion of the backshell has a rotatable connector coupling nut. To date, it has been necessary with this type of connector to involve pigtailing the individual screens, as in the iris spring type discussed above, and a solder sleeve to collect and terminate together with a tail to complete the termination of the backshell.

The object of the present invention is to provide a backshell for a multicore connector for cables having individually screened wires, which backshell is relatively easy to assembly irrespective of the number of wires making up a given cable.

According to one aspect of the present invention there is provided a backshell for a connector for a multicore cable of the type formed from a plurality of individually screened wires, the backshell being generally cylindrical and releasably attachable to a connector and, in use, having the cable passing therethrough, the backshell comprising an electrically-conductive body portion, termination means releasably attachable to the body portion, and an electrically-conductive inner cylindrical member having a slot extending from one end and generally parallel to the longitudinal axis of the inner member, the slot, in use, receiving one end of an electrically-conductive ribbon wound around the wires of the cable in contact with the individual screens thereof, the inner cylindrical member being rotatable so as to wind the ribbon around the periphery of the cable surrounded by the inner member, the application of the termination means to the backshell body portion serving electrically to connect the individual wire screens to the backshell and hence to the connector.

In one arrangement, the slotted inner member may be integral with the backshell body portion and be externally threaded to receive the termination means in the form of a termination nut or backnut, the ribbon extending through the slot being trapped between the exterior surface of the slotted member and the backnut when the latter is applied to provide the necessary electrical connection between the individual wire screens and the backshell and hence the connector. If the cable is provided with an overall screen, this can be pulled over the ribbon extending through the slot in the inner member, whereby that too is trapped between the inner member and backnut on application of the latter. Preferably, the ribbon is wound $1\frac{1}{4}$ times around the inner member although the extent of this winding or wrapping will depend on the space available between the inner member and the backnut which are preferably coarse threaded.

In another arrangement the slotted inner member is separate from the backshell body portion. In this arrangement, the backshell further comprises electrically-conductive means in use disposed between the inner member and the termination means, which again may be a termination nut or backnut, and being deformable, on attachment of the termination means to the backshell body portion, onto electrical contact with inner member and ribbon.

According to another aspect of the present invention, there is provided a method of connecting a multicore cable to a two-part connector, the cable being formed from a plurality of individually screened wires the method comprising the steps of:

1. stripping the insulation, if provided, from each wire to be connected to the connector to reveal the individual wire screening over a predetermined length of the wire, 2. winding an electrically-conductive ribbon of material around the stripped portions of the wires so that the ribbon contacts at least once the screening of each wire, 3. placing a generally cylindrical electrically-conductive member over the ribbon-wound portion of the cable, the member being slotted to receive the free end of the ribbon, 4. rotating the cylindrical member so as to wind the ribbon around the periphery of the cable surrounded by the member, 5. connecting together the two parts of the connector so as electrically to connect the individual wire screens to the connector via the ribbon and the cylindrical member.

The two parts of the connector may be constituted by a multi-pin connector and an associated backshell and the cylindrical member may be a separate component of the backshell or be integral with a body portion of the backshell, when the cylindrical member is a separate component, electrically-conductive means may be disposed between a releasable part of the backshell and the cylindrical member, these means being deformable, on the attachment of the releasable part to the backshell body portion, into electrical contact with the cylindrical member and ribbon.

The method may comprise the further step of winding the ribbon around the exterior of the cylindrical member once rotation of the inner member to wind the ribbon around the cable has been completed. The ribbon may be secured in position on the cylindrical member, such as by lacing, prior to the assembly of the two parts of the connector.

For cables which have an overall screen as well as individually screened wires, the method of connecting the connector is essentially the same, the only difference being that the overall screen is first pulled back in order to gain access to the individual wires and is then pulled over the cylindrical member once rotation thereof has been completed, whereby the overall screen is disposed between the cylindrical member and the connector.

The present invention provides a backshell for a multicore connector and a method of attaching such a connector to a multicore cable which achieves extremely good electrical contact with the screening of the individual wires. The assembly of the electrically conductive ribbon is relatively simple irrespective of the number of individual wires making up a given cable because the ribbon is applied from the free end of the cable so that access to the individual wires is readily gained. The ribbon is arranged to contact at least once the screen of each individual wire although if a given screen is contacted more than once, then all well and good.

It was first thought that it might be possible to achieve the electrical connection between the overall connector and the individual wire screens merely by revealing the wire screens over a predetermined length of the cable and then using the known connector with the iris spring to achieve the desired electrical contact. However, it was found that this was unsatisfactory in that if insufficient deformation of the iris spring took place, then certain wires towards the centre of the bundle might not have their screens electrically connected to the connector. Alternatively, if the deformation was such as to achieve the electrical connection of all individual screens to the connector (although this could never be guaranteed), then a deformation of the wires themselves could take place which is undesirable in general and also in particular when considering the possibility of having to remove the connector for rework/repair purposes and then reassemble it. Furthermore, the exent of iris spring deformation to ensure good electrical contact is such that it may have been necessary to employ a machine assembly procedure as opposed to relying solely on a manual connection of a connector and backshell in view of the forces involved. With the present invention, a connector can be assembled entirely manually and still achieve a consistent and reliable electrical connection.

The invention not only provides the desired electrical connection between connector and wire screens but also enables standardisation in as much as the inner cylindrical member of the backshell is self-adjusting regarding the amount of ribbon which is required to fill the radial gap between the inner diameter of the member and the outer diameter of the cable surrounded thereby. Another advantage of the present invention is that there is no requirement to interrupt the screening of the individual wires so that there is no electrical window as is the case with conventional connectors for cables having individually screened wires.

Backshells for connectors for multicore cables formed from a plurality of individually screened wires and constructed in accordance with the present invention will now be described in greater detail, by way of example, with reference to the accompanying drawings, in which.

Figure 1:
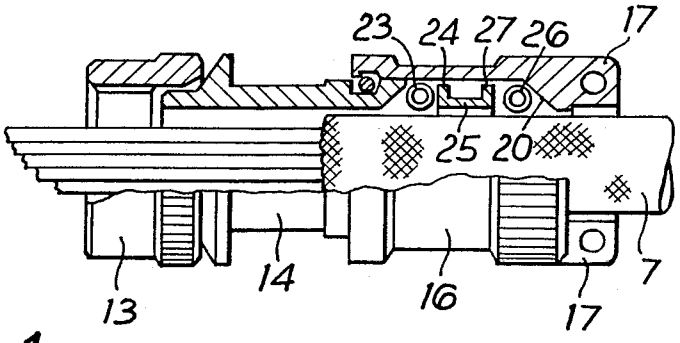
FIG. 1 is a side view, partly in section, of a first embodiment of connector and backshell partly assembled onto a cable.
Figure 3:
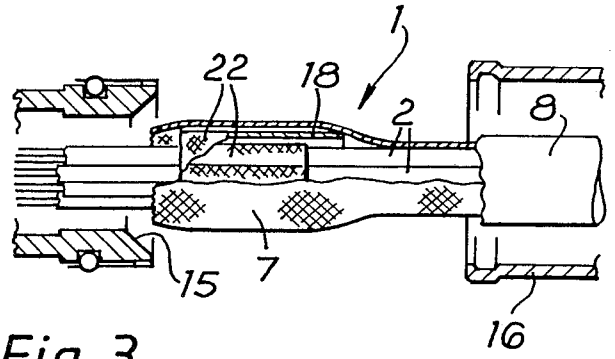

Referring to FIGS. 1 to 4 of the drawings, there is illustrated a first embodiment of a connector for a multicore cable 1 which is formed by a plurality of individual wires 2 each comprising a conductor 3 covered by an insulating sleeve 4 which in turn is covered by an electrically-conductive screen or sheath 5 which in its turn is covered by a further insulating sleeve 6. The individual wires 2 are formed into a bundle of generally circular cross-section and an overall screen in the form of a sheath or sleeve 7 is provided for the bundle. Finally, an outer insulating sleeve 8 is provided for the bundle of individual wires to complete the cable 1. The individual screen 5 and the overall screen 7 are of the conventional form, i.e. a plaited braid formed from fine metallic strands which typically are of copper with a silver or nickel plated outer layer. However, the precise make up of the screens 5 and 7 is immaterial to the present invention.

The basic connector is, in the main, of conventional form and comprises a connector body 9 which is generally cylindrical and fits over the free end of the cable 1, being provided with a multipin connector 11 at its outer end and fitted with a relatively rotatable coupling 12 by which the overall connector is attached to the apparatus (not shown) to which the cable is to be connected via a mating half (also not shown). The other end of the main body 9 of the connector is externally threaded to receive the internally threaded end of a coupling nut 13 forming part of a backshell for the connector and being freely rotatable on a main cylindrical body 14 of the backshell. The end of the backshell body 14 is provided with a chamfered edge 15, the chamfer extending from the end of the body 14 and axially inwardly thereof. This end of the body 14 is externally threaded to receive an internally threaded end of a backshell backnut 16 having at or towards its other end an internal flange 20 which tapers towards the centre of the backshell. At this end of the backnut 16, there is provided a pair of diametrically opposed lugs 17 which are apertured to receive a cable clamp (not shown) in the conventional manner. It will be appreciated that the components 13, 14 and 16 of the backshell are all cylindrical with the cable 1 passing generally axially therethrough. Furthermore, these components, together with the main body 9 and the coupling nut 12 of the connector, are made from metal which is typically aluminum although other metals can be used, depending on the application.

The backshell is provided with an inner cylindrical member 18 which is conveniently formed from aluminum although if the other metallic components of the connector are formed from a different metal, such as stainless steel, then the member 18 may be plated, for example with nickel, in order to provide a compatability with the connector material so as to prevent any electrochemical reaction therebetween. The inner backshell member 18 is provided with a slot 19 which extends from the end thereof adjacent the main body 9 of the connector and terminates short of the opposite end.

Figure 2:
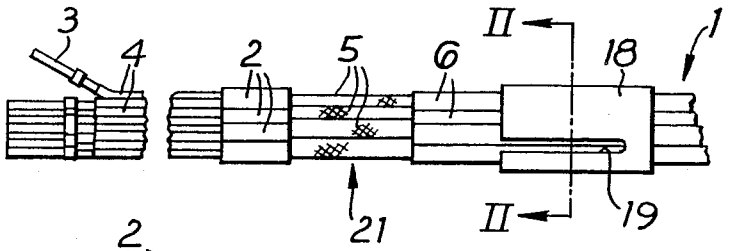
FIG. 2 is an enlarged section of the line II—II of FIG. 1, FIGS. 3 and 4 show progressive stages of assembly of the connector and backshell of FIG. 1.
Figure 2:
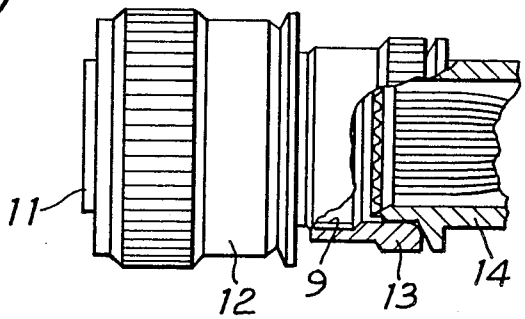
Figure 2:
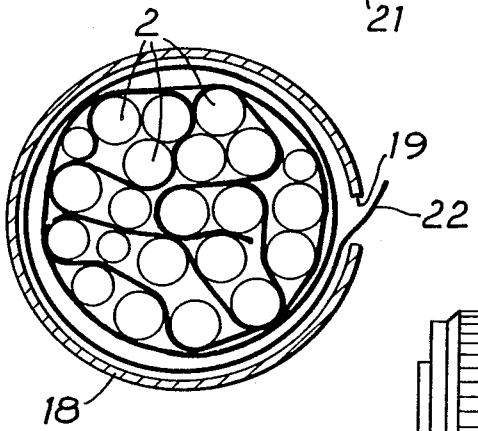
Figure 4:
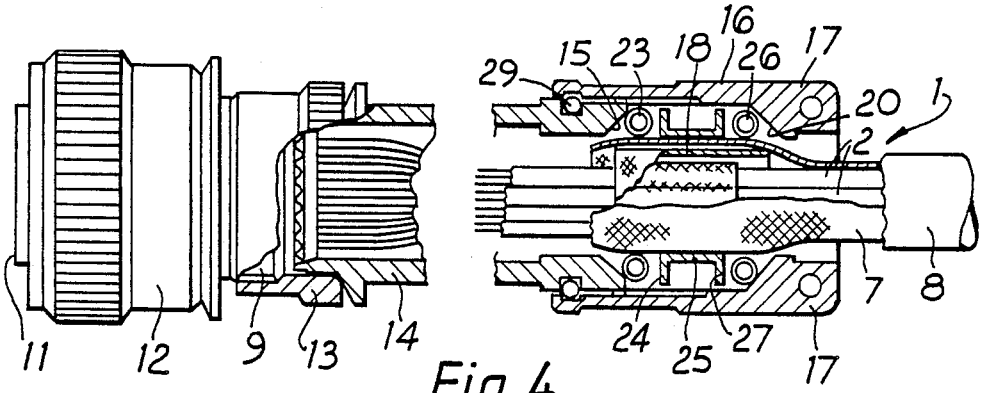
Figure 5:
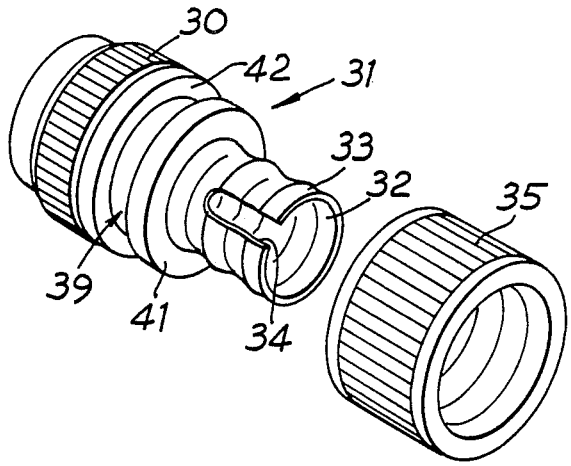
FIG. 5 is a perspective view of a second embodiment of connector and backshell.
Figure 6:
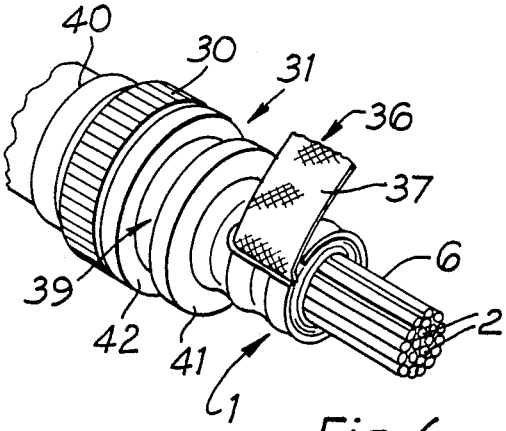
FIGS. 6, 7 and 8 show progressive stages of assembly of the connector and backshell of FIG. 5.
Figure 7:
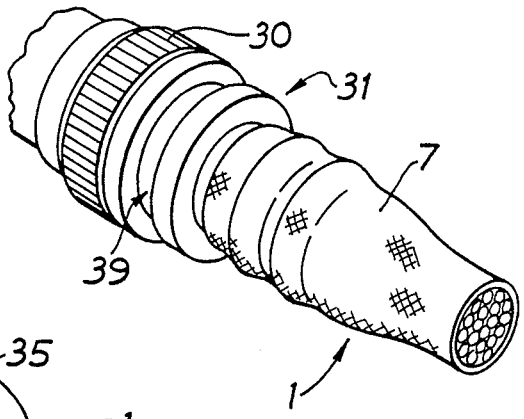
Figure 8:
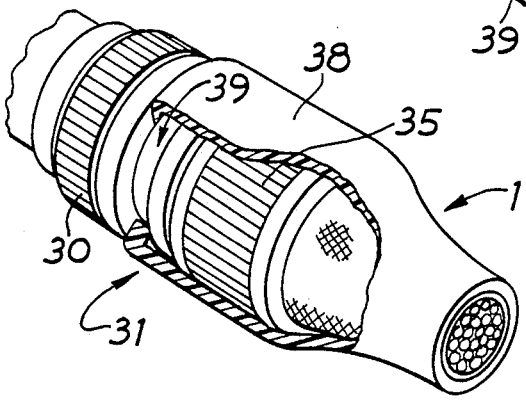
Figure 9:
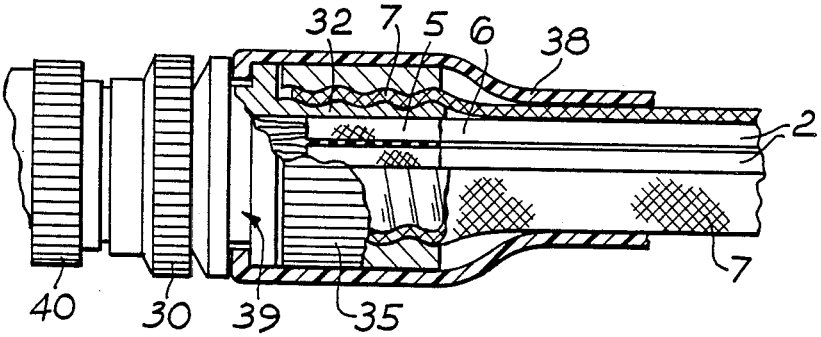
FIG. 9 is a partial longitudinal section of the fully assembled connector of FIG. 8.
Figure 10:
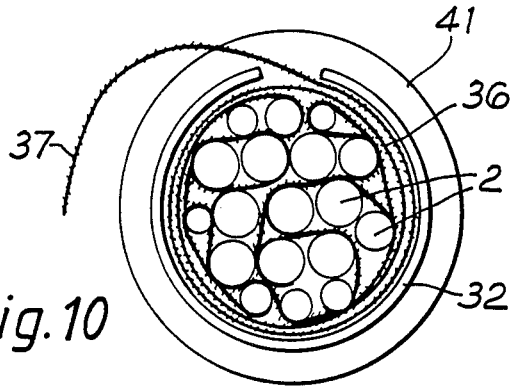
FIG. 10 is an enlarged end view of FIG. 6.

In order to assemble the connector on the cable 1, the outer tips of the individual wires 2 are first stripped of the outer insulating sleeve 6, the screen 5 and the inner insulating sleeve 4 in order to bare the conductor 3 for a predetermined length. These bared ends are then ready for subsequent connection, such as by crimping, to the appropriate pin or contact of the multipin portion 11 of the connector. Prior to this operation, the overall outer insulating sleeve 8 of the cable has, of course, been removed for a predetermined length and the overall screen 7 folded back on itself so as to prepare the cable as illustrated in FIG. 1. Next, the outer insulating sleeve 6 of each wire 2 is removed over a predetermined length and at a predetermined location as indicated at 21 in FIG. 1. Thus, the screen 5 on each of the individual wires 2 is bared and the next stage of assembly of the connector is to wind an electrically-conductive ribbon 22 (FIG. 2) through the bundle of wires 2 in the region where the individual screens 5 have been bared. The result of this winding assembly step is illustrated diagrammatically in FIG. 2 of the drawings, it being appreciated that the actual winding of the ribbon 22 is effected by splaying apart the individual wires 2 of the bundle which is possible from the free end of the cable. It is important to ensure that the ribbon 22 is so wound around the individual wires 2 that each wire is contacted thereby at least once. FIG. 2 illustrates cable formed from some twenty-two individual wires 2 but the invention is applicable to bundles having a greater number of wires, for example a bundle of upwards of 80 wires. The winding of the ribbon 22 is relatively easily accomplished even with such a large number of wires and when winding has been completed, the ribbon 22 is taken around the periphery of the bundle of wires. The inner backshell member 18 is then slid along the cable from the position illustrated in FIG. 1 towards the bared region 21 so as to receive the free end of the ribbon 22 within the slot 19. When the inner backshell member 18 has thus been positioned, it is then manually rotated so as further to wind the ribbon 22 around the bundle of wires 22 in the same direction as previously and in so doing, the effective outer diameter of the bundle of wires 22 is increased until such time as the interior of the backshell member 18 is packed tight with the ribbon 22. At this point, the ribbon 22 is then wrapped, preferably once, around the inner backshell member 18 and secured in position by lacing tape or other means.

Next, the coupling nut 13 and backshell body 14 are slid as a unit along the cable 1 to the main body 9 and the nut screwed onto the latter. At this point, the overall screen 7 is brought forward again so as to cover the inner backshell member 18 with the ribbon 22 wound therearound. Finally, the backshell backnut 16 is slid along the cable 1 and screwed onto the backshell body 14, the completed assembly being illustrated in FIG. 4 of the drawings. The attachment of the backshell backnut 16 to the backshell body 14 compresses a first iris spring 23 between the chamfered end 15 of the backshell body 14 and one flange 24 of a double flanged collar 25 disposed within the backshell. A second iris spring 26 is compressed between the second flange 27 of the collar 25 and the tapered flange 20 at the end of the backnut 16. These components of the backshell are conventional and the axial and radial compression of the iris springs 23 and 26 results in the springs electrically bridging the backshell, and hence overall connector, with the individual screens 5 of the wires 2 through the intermediary of the ribbon 22 wound around the screens, the inner backshell member 18, the ribbon wound around the exterior of the backshell member 18 and, finally, the overall screen 7. Thus, each screen 5 of the individual wires 2 is directly connected to the connector in order to preserve electrical screening and this is achieved in a relatively simple but highly reliable manner which is a significant advance in the art compared with the known connector which involves laborious pigtailing of the individual wire screens. Furthermore, the individual wire screens 5 extend right up to the point at which the conductors of the wires 2 are bared for connection to the pins of the connector, although FIG. 1 does not illustrate this as it is convenient to show the other components of the wire. Thus, there is no electrical window which is a distinct advantage of the present invention. Another advantage of the invention is that a connector is assembled entirely manually, with no special tools being required and the positive electrical connection between the individual screens 5 and the connector is effected without any deformation of the wires 2. Accordingly, the connector can be disassembled for reworking of the bundle of wires and/or repair and reassembled without impairing the effectiveness of the electrical connection of the screens 5 to the connector.

The electrically conductive ribbon 22 is preferably a wire mesh such as that manufactured under the trade name Knitex. Varying widths of ribbon 22 may be employed but it has been found convenient to bare the individual wire screens 5 for an axial length of the order to 20 mm so as to accommodate a ribbon width of the order of 18 mm. The thickness of the mesh is of the order of 0.8 mm and it has been found that if the slot 19 in the inner backshell member 18 is made twice this width, this is acceptable although there is no critical relationship between these two dimensions. It has also been found convenient to provide the slot 19 of the inner backshell member 18 for approximately three quarters of the length thereof in order to provide sufficient structural strength to the inner backshell member 18, which strength is desirable in order that undue crushing of the member does not occur when the iris springs 22 and 25 are radially compressed during the final connector assembly step.

An O-ring 29 is provided between the backshell backnut 16 and the component 14 in order to provide a fluid tight seal and a further O-ring may be provided, if desired, between the second iris spring 26 and the tapered flange 20 of the backshell backnut 16. It should be appreciated that the invention may be performed using only a single iris spring in the backshell.

Turning now to FIGS. 5 to 10 of the drawings, these illustrate an alternative and simpler embodiment of connector constructed in accordance with the present invention. Again, the connector is for a multicore cable 1 which is formed by a plurality of individual wires 2 each having a conductor covered by an insulating sleeve which in turn is covered by an electrically-conductive screen or sheet 5 which in its turn is covered by a further insulating sleeve 6. The individual wires 2 are formed into a bundle of generally circular cross-section and an overall screen in the form of a sheath or sleeve 7 is provided for the bundle. These components of the cable are similar to that described with respect to the first embodiment shown in FIGS. 1–4 of the drawings and and thus like reference numerals have been used. Again, the individual screen 5 and the overall screen 7 are of the conventional form, i.e. a plaited braid formed from fine metallic strands which are typically of copper with a silver or nickel plated outer layer.

In this embodiment, the connector comprises a backshell having a body portion 31 provided with a coupling connector nut 30 which is freely rotatable on the body portion and releasably attachable to a connector 40. The body portion 31 of the backshell is generally cylindrical and is formed integrally with an inner cylindrical member 32 which extends axially from the body portion and is provided externally with a coarse thread 33. The inner cylindrical member 32 is provided with a slot 34 extending generally parallel to the axis of the member from one end thereof and terminating at or towards the end, which end is integral with the backshell body portion 31. In view of the integral nature of the body portion 31 and the cylindrical member 32, there is no concern in this arrangement for the structural strength of the cylindrical member 32, whereby the slot 34 can virtually extend the full length thereof. The second part of the connector is by way of termination means in the form of a termination nut or backnut 35 which is internally coarse threaded complementary to the thread on the inner cylindrical member 32.

The individual wires of the cable are prepared as described in connection with the embodiment of FIGS. 1 to 4 of the drawings, that is the outer tips of the individual wires 2 are first stripped of the outer insulating sleeve 6, the screen 5 and the inner insulating sleeve in order to bare the conductor for a predetermined length. These bared ends are then ready for subsequent connection, such as by crimping, to the appropriate pin or contact of the connector coupling member 32. As before, the overall screen 7 has been folded back on itself prior to the operation just described.

Next, the outer insulating sleeve of each wire 2 is removed over a predetermined length so as to reveal the screen 5 on each of the individual wires. The next stage of assembly is to wind an electrically-conductive ribbon 36, similar to the ribbon 22 of the first embodiment, through the bundle of wires in the region where the individual screens 5 have been bared in the same manner as described in connection with the first embodiment so that each individual screen 5 is contacted at least once by the ribbon 36 as diagrammatically illustrated in FIG. 10 of the drawings. The backshell body 31 is then brought forward making sure that the free end of the ribbon 36 passes through the slot 34 in the inner cylindrical member 32. The backshell body 31 is then rotated so as to wind the ribbon 36 around the periphery of the bundle of wires 2 so as to build up the diameter thereof until it matches the inner diameter of the cylindrical member 32. The ribbon 36 is then cut so as to leave a tail portion 37 of a length sufficient to wind around the outer surface of the inner cylindrical member 32 by an amount approximately equal to $1\frac{1}{4}$–$1\frac{1}{2}$ turns. The connector coupling 40 is then fully screwed onto the backshell body 31 so as to engage anti-rotation teeth (not shown) and finally, the termination nut or backnut 35 is screwed onto the inner cylindrical member 32, thus trapping between these two components the overall screen 7 and the tail 37 of the ribbon 36 wound around the cylindrical member 32. Thus, there is a very good electrical connection between the body of the connector and the individual screens 5 of the wires 2 via the ribbon 35, in a cylindrical member 32 and the overall cable screen 7.

To achieve environmental sealing, the cable assembly can now be fitted with a shrink boot 38 (FIG. 8) to engage with an annular groove 39 provided between two flanges 41 and 42 on the backshell body 31.

The invention as applied to the two-part connector of FIGS. 5–10 offers a simple, no-fuss way of terminating individual wire screens, individual and overall screens, or overall screens, within one device, whereby a universal connector is provided with a significant saving in costs. As with the embodiment of FIGS. 1 to 4, it will be appreciated that the number of wires in a given cable bundle is immaterial because the other diameter thereof can be made up to the inner diameter of the cylindrical member 32 of the backshell 31 merely by providing the necessary number of turns of electrically-conductive ribbon therearound.

We claim:

1. In combination a connector, a multicore cable of the type formed from a plurality of wires having individual screens, and an electrically conductive ribbon, the connector having a backshell which is generally cylindrical and releasably attachable to the connector and having the cable passing therethrough, the backshell comprising an electrically-conductive body portion, termination means releasably attachable to the body portion, and an electrically-conductive inner cylindrical member having a slot extending from one end and generally parallel to the longitudinal axis of the inner member, the slot receiving one end of said electrically-conductive ribbon wound around the wires of the cable in contact with the individual screens thereof, the inner cylindrical member being rotatable so as to wind the ribbon around the periphery of the cable surrounded by the inner member, the application of the termination means to the backshell body portion serving electrically to connect the individual wire screens to the backshell and hence to the connector.

2. A backshell according to claim 1, wherein the slotted inner member is integral with the backshell body portion and is externally threaded to receive the termination means, the ribbon extending through the slot being trapped between the exterior surface of the slotted member and the termination means when the latter is applied to provide the necessary electrical connection between the individual wire screens and the backshell and hence the connector.

3. A backshell according to claim 1, wherein the slotted inner member is separate from the backshell body portion, the backshell further comprising electrically-conductive means in use disposed between the inner member and the termination means and being deformable, on attachment of the termination means, to the backshell body portion, into electrical contact with the inner member and the ribbon.

4. A backshell according to claims 1, or 2, or 3, wherein the termination means is in the form of a backnut.

* * * * *